United States Patent [19]

Heren

[11] Patent Number: 4,784,329

[45] Date of Patent: Nov. 15, 1988

[54] GEAR DRIVEN PORTABLE LAWN SPRINKLER

[75] Inventor: Lawrence P. Heren, Peoria, Ill.

[73] Assignee: L. R. Nelson Corporation, Peoria, Ill.

[21] Appl. No.: 875,097

[22] Filed: Jun. 17, 1986

[51] Int. Cl.[4] ..... B05B 1/26; B05B 3/00

[52] U.S. Cl. ..... 239/498; 239/247; 239/512; 239/513

[58] Field of Search ..... 239/203–206, 239/237, 240, 241, 247, 498, 505, 509–513, DIG. 1

[56] References Cited

U.S. PATENT DOCUMENTS

| | | | |
|---|---|---|---|
| 575,966 | 1/1987 | Main | 239/240 |
| 2,228,720 | 1/1941 | Coles | 239/237 X |
| 2,693,390 | 11/1954 | Spender | 239/240 X |
| 3,272,437 | 9/1966 | Coson | 239/240 X |
| 3,712,545 | 1/1973 | Felix | 239/240 X |
| 3,854,664 | 12/1974 | Hunter | 239/240 X |
| 4,353,506 | 10/1982 | Hayes | 239/206 |
| 4,625,914 | 12/1986 | Sexton et al. | 239/241 X |

*Primary Examiner*—Andres Kashnikow
*Assistant Examiner*—Patrick N. Burkhart
*Attorney, Agent, or Firm*—Cushman, Darby & Cushman

[57] ABSTRACT

A portable lawn sprinkler comprising a housing assembly having means defining a fixed horizontally extending water inlet having a female hose fitting on the exterior end thereof and a spaced fixed annular wall providing an interior periphery defining an annular vertically opening water outlet. A speed reducing unit is mounted within the housing assembly. An impeller is drivingly associated with the input shaft of the speed reducing unit in a position to be rotated by water under pressure flowing from the inlet to the outlet. A rotary water distributor is fixed to the output shaft of the speed reducing unit disposed in water communicating relation with the outlet. An annular member is mounted for axial movement within the annular water outlet and in surrounding relation with the output shaft and has an exterior periphery disposed within the interior periphery of said fixed annular wall. An O-ring seal sealingly is mounted between the exterior of the annular member and the interior periphery of the fixed annular wall in such a way as to accommodate any relative axial movement of the annular member with respect to the fixed annular wall. A spring acts between the housing assembly and the annular member so as to resiliently urge the latter upwardly and to maintain an upwardly facing sealing surface on the annular member in sealing engagement with a downwardly facing sealing surface on the rotary distributor. The housing assembly provides interior flow directing surfaces for directing the water therein to flow from the impeller and then upwardly between the output shaft and the annular member into communicating relation to the rotary distributor.

5 Claims, 3 Drawing Sheets

10
12
14
16
26
30
32
34
82
96
102
104
106
112
114
116
118
120
122
123
124
126
128
130
132
134
136
2
6

GEAR DRIVEN PORTABLE LAWN SPRINKLER

This invention relates to lawn sprinklers and more particularly to lawn sprinklers of the type having gear driven rotary distributors.

An example of the type of gear driven rotary distributor herein contemplated is disclosed in commonly assigned U.S. Pat. No. 4,353,506. The patent discloses a pop-up sprinkler in which the rotary distributor is embodied in a pop-up head and cooperates with a pattern plate for the purpose of enabling the sprinkler to be utilized in positions within the underground installation requiring partcircle patterns. The seal assembly for the rotary distributor head of the sprinkler is particularly suited to the provision of a partial pattern type arrangement.

An object of the present invention is to provide a portable lawn sprinkler having a rotary distributor of the type disclosed in the aforesaid patent. In accordance with the principles of the present invention, this objective is achieved by providing a portable lawn sprinkler comprising a housing assembly having a fixed horizontally extending water inlet provided with a female hose fitting on the exterior end thereof and a spaced fixed annular wall providing an interior periphery defining an annular vertically opening water outlet. A speed reducing unit is mounted within the housing assembly. An impeller is drivingly associated with the input shaft of the speed reducing unit in a position to be rotated by water under pressure flowing from the inlet to the outlet. A rotary water distributor is fixed to the output shaft of the speed reducing unit disposed in water communicating relation with the outlet. An annular member is mounted for axial movement within the annular water outlet and in surrounding relation with the output shaft and has an exterior periphery disposed within the interior periphery of the fixed annular wall. An O-ring seal is sealingly mounted between the exterior periphery of the annular member and the interior periphery of the fixed annular wall in such a way as to accommodate any relative axial movement of the annular member with respect to the fixed annular wall. A spring acts between the housing assembly and the annular member so as to resiliently urge the latter upwardly and to maintain an upwardly facing sealing surface on the annular member in sealing engagement with a downwardly facing sealing surface on the rotary distributor. The housing assembly provides interior flow directing surfaces for directing the water therein to flow from the impeller and then upwardly between the output shaft and the annular member into communicating relation to the rotary distributor.

Another object of the present invention is the provision of a portable lawn sprinkler of the type described which is simple in construction, effective in operation and economical to manufacture.

These and other objects of the present invention will become more apparent during the course of the following detailed description and appended claims.

The invention may best be understood with reference to the accompany drawings wherein an illustrative embodiment is shown.

IN THE DRAWINGS

Figures 1, 5, 6:
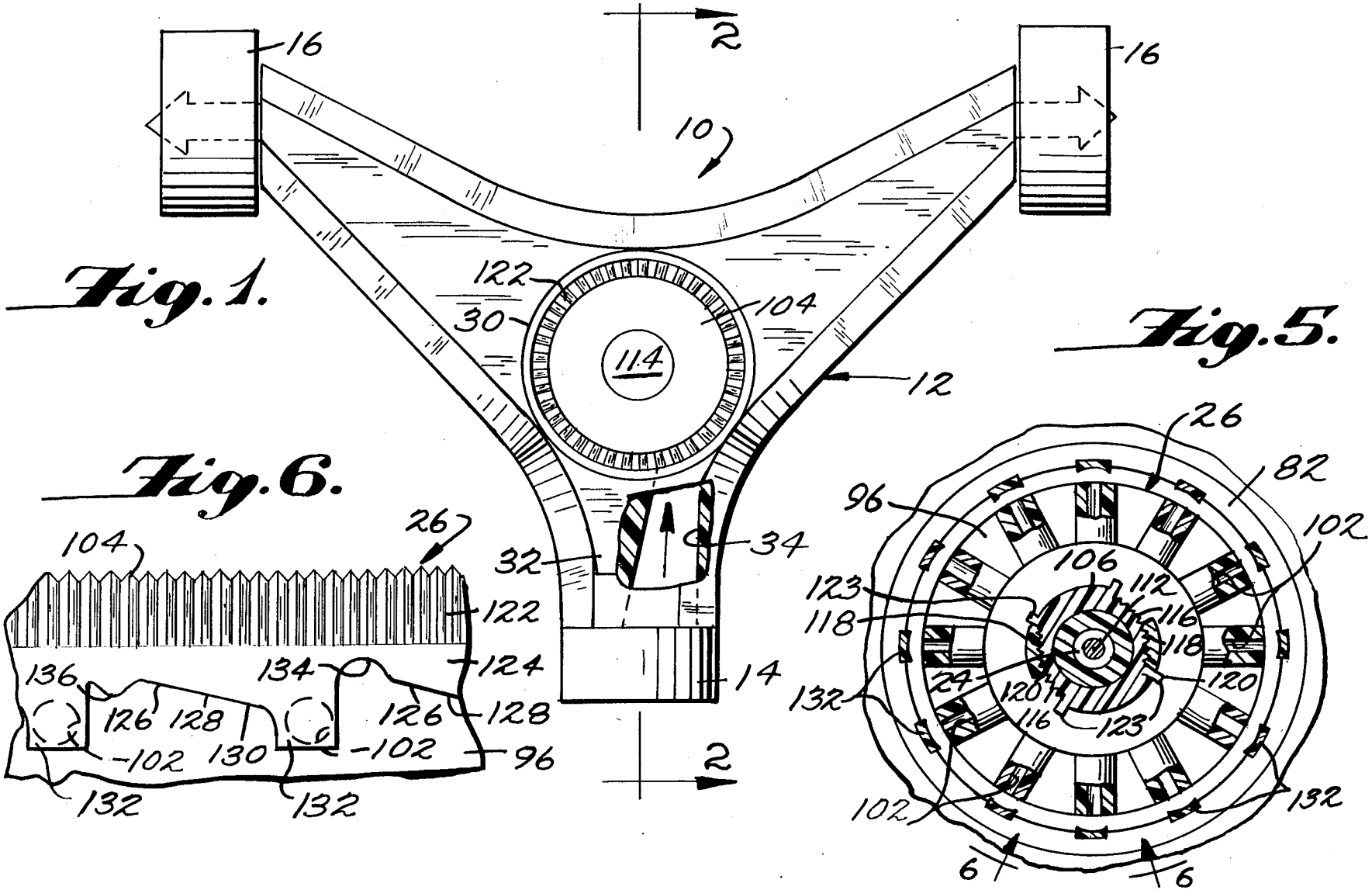
FIG. 1 is a top plan view of a portable lawn sprinkler embodying the principles of the present invention with certain parts shown in section for purposes of clearer illustration.
FIG. 5 is an enlarged fragmentary sectional view taken along the line 5—5 of FIG. 2.
FIG. 6 is a fragmentary side elevational view looking in the direction of arrows indicated at 6—6 in FIG. 5.

Referring now more particularly to the drawings, there is shown therein a portable lawn sprinkler, generally indicated at 10, which embodies the principles of the present invention. The sprinkler 10 includes a housing assembly, generally indicated at 12, which provides a female hose fitting 14 adapted to be connected with a male hose fitting on a hose, not shown, containing a source of water under pressure. As shown, the housing assembly 12 is provided with a pair of spaced rear wheels 16 and a front support leg 18 adjacent the female fitting 14 which serve to support the housing assembly on a lawn or other area to be sprinkled.

Mounted within the housing assembly 12 is a water impeller 20 which is connected through a speed reducing unit, generally indicated at 22, to an output shaft 24. Fixed to the output shaft 24 is a rotary water distributor, generally indicated at 26, which receives water under pressure flowing within the housing assembly 12 and distributes the same within a circular pattern area on the lawn to be sprinkled. An annular spring pressed seal assembly, generally indicated at 28, serves to provide a seal between the rotary distributor 26 and the housing assembly 12 for containing the water under pressure therein so that the same will pass outwardly through the rotary distributor 26.

Figure 2:
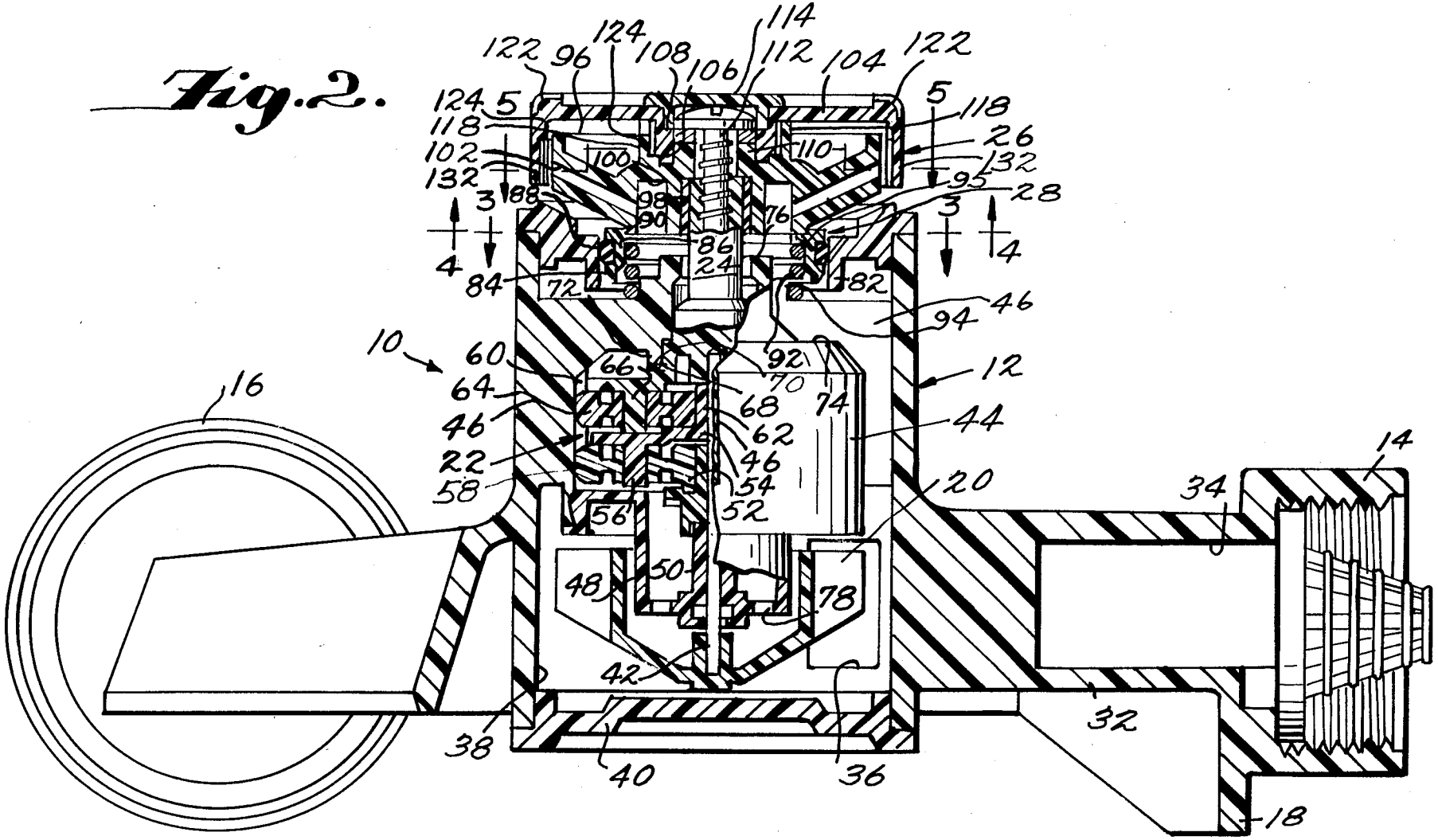
FIG. 2 is an enlarged sectional view taken along the line 2—2 of FIG. 1 with certain parts shown in elevation for purposes of clearer illustration.

As best shown in FIG. 2, the housing assembly 12 includes a main plastic housing body which includes a cylindrical outer wall 30 disposed with its axis extending vertically and a tubular wall 32 extending horizontally from the inlet female fitting 14 into the lower portion of the outer cylindrical wall 30. As shown, the tubular wall 32 defines an inlet 34 which is open at its outer end to receive the water under pressure within the hose connected with the female fitting 14. The inner end of the inlet 34 opens tangentially, as indicated at 36, into an annular chamber 38 defined in the lower open end of the outer wall 30 which is closed by a lower end closure 40. The chamber 38 constitutes an impeller chamber within which the impeller 20 is rotatably mounted. As shown, the impeller 20 is fixed to the lower end of an input shaft 42 forming a part of the speed reducing unit 22.

The speed reducing unit 22 may be made up of any desired construction. However, as shown, the speed reducing unit is preferably in the form of a plurality of planetary gear sets which are suitably mounted between the input shaft 42 and the output shaft 24. The planetary gear sets are mounted within a casing construction the majority of which is provided by an inner cylindrical wall 44 disposed in concentric relation with the outer cylindrical wall 30 and integrally interconnected therewith by a plurality (e.g. four) of annularly spaced ribs 46 extending radially inwardly from the inner periphery of the outer cylindrical wall 30 to the exterior periphery of the inner cylindrical wall 34. The inner wall 34 opens downwardly and is closed by a bottom closure member 48 which constitutes a part of the casing for the speed reducing unit.

The bottom closure 48 includes a hub 50 which serves to rotatably mount the portion of the input shaft 42 directly above the connection thereof with the impeller 20. Fixed to the shaft 42 above the hub 50 is a sun gear 52 forming a part of the first planetary gear set which includes a carrier 54 defining a plurality of annularly spaced shafts 56 on which are journalled a plurality of planet gears 58. The exterior periphery of the planet gears 58 are adapted to mesh with gear teeth 60 integrally formed on the interior periphery of the inner cylindrical wall 44. The gear teeth 60 constitute a common orbital gear for all of the planetary gear sets. In this regard it will be noted that the carrier 54 also has formed on the upper central portion thereof a sun gear 62 which meshes with a series of planet gears 64 journalled on shafts 66 formed as an integral part of the bottom portion of the output shaft 24. As shown, the output shaft 24 also provides an upwardly facing annular shoulder 68 on which is mounted an antifriction washer 70. Washer 70 also engages a downwardly facing surface of a depending sleeve portion 72 formed on an annular wall portion 74 extending radially inwardly from the upper end of the inner cylindrical wall 44. The inner periphery of the annular wall portion 74 includes an upwardly projecting annular portion 76 which is disposed in surrounding relation to the lower portion of the output shaft 24.

The antifriction washer 70 serves as an effective watertight seal for the upper end of the casing, the lower end of which is provided with openings 78 which allow for the introduction of water into the interior of the casing in surrounding relation to the planetary gear sets operative therein.

Mounted within the open upper end of the outer cylindrical wall 30 of the housing assembly 12 is an annular member 80 which constitutes an upper end closure for the housing assembly. Annular member 80 includes an inner cylindrical wall 82 defining an interior cylindrical surface 84. The surface 84 constitutes an outlet for the water under pressure which is introduced into the interior of the housing assembly 12 through the inlet 34. The annular sealing assembly 28 includes an annular sealing member 86 which is disposed within the outlet 84 in surrounding relation with the output shaft 24 which extends vertically upwardly through the outlet 84.

The annular seal assembly 28 also includes an O-ring 88 which is suitably mounted within an annular groove formed in the annular seal member 86 and disposed so that its exterior periphery slidably sealingly engages the interior cylindrical surface 84 defining the opening. The annular sealing member 86 includes a spring engaging annular flange portion 90 extending radially inwardly from the upper end thereof. The lower surface of the annular flange portion 90 is adapted to engage the upper end of a coil spring 92 which is disposed in surrounding relation with the housing portion 76 and the adjacent portion of the output shaft 24. Preferably, the inner upper ends of each of the ribs 46 is formed with an upwardly extending guide portion 94. The guide portions 94 extend within the lower volutes of the spring 92 and serve to maintain the spring in centered relation. The spring 92 thus serves to resiliently urge the sealing member 86 in an upward direction so that the upwardly facing surface defined by the flange portion 90 will sealingly engage a downwardly facing annular sealing surface 95 formed on lower portion of a rotary head member 96 forming a part of the rotary distributor 26.

Figure 4:
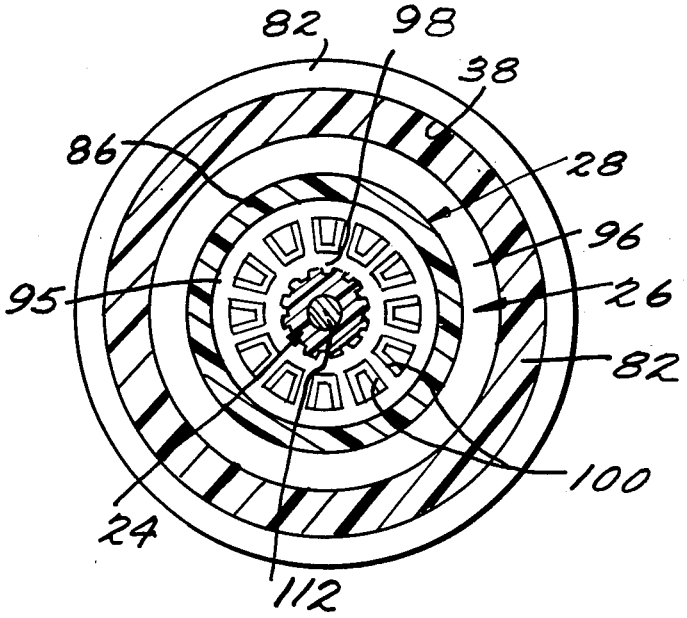
FIG. 4 is an enlarged sectional view taken along the line 4—4 of FIG. 2.

Referring now more particularly to FIGS. 2, 4, and 5, the rotary head member 96 also has a central interiorly splined shaft engaging socket portion 98. The socket portion 98 is configured to be fixed to the upper end of the output shaft 24 which is provided with cooperating exterior splines. The head member 96 includes a multiplicity of annularly spaced water inlets 100. As best shown in FIG. 4 there are twelve inlets provided, each being of generally frustosegmental configuration and each extending upwardly from the lower surface of the member 96 at a position radially outwardly of the sealing surface 95. Each inlet 100 constitutes the inlet end of a flow passage extending through the rotary head member 96, the outlet end of which is defined by an upwardly and outwardly extending outlet 102.

As best shown in FIGS. 1, 4 and 6, each outlet 102 communicates at its inner end with the associated inlet 100 and extends upwardly and outwardly to the exterior periphery of the rotary head member 96 so as to define a water stream which issues therefrom in an upwardly and outwardly direction. In this way the rotary sprinkler head member 96 provides for the issuance of twelve annularly spaced water streams from the exterior periphery thereof.

The rotary sprinkler distributor 28 in addition to the rotary head member 96 also includes a stream modifying cap member 104. Member 104 includes a central depending hub portion 106 which includes an interior upwardly facing shoulder 108. The rotary head member 96 includes a central upstanding cylindrical portion 110 of a size to receive the lower end of the depending hub portion 106 of the cap member. As best shown in FIG. 1, the interengagement of the portions 106 and 110 serves to mount the cap member 104 on the rotary head member 96 for rotational movement about the axis of rotation of the shaft 24 and rotary head member 96. A bolt and washer assembly 112 serves the dual purpose of retaining the rotary head member in fixed relation on the end of the output shaft 24 and the cap member on the rotary head member for independent rotation, as aforesaid. Preferably, a cover member 114 is snapped onto the central portion of the cap member to cover the head of the bolt 112 so as to protect the same and to enhance the appearance of the assembly.

Cap member 104 in addition to the rotary mounting thus far described is mounted with respect to the head member 96 for incremental indexed rotary movement as well. To this end, the upper exterior periphery of the depending hub portion 106 is formed with a multiplicity of serrations 116 of V-shaped cross-sectional configuration. Head member 96 is formed with a pair of annularly spaced integral yieldable indexing portions 118 extending upwardly therefrom in a position adjacent the periphery of the hub portion 106 of the cap member. As shown, the interior surface of each indexing portion 118 is serrated, as indicated at 120, so as to cooperatively engage the serrations 116 on the hub portion of the cap member.

The upper exterior and outer periphery of the cap member 104 includes manually engageable serrations 122 which provide a means for facilitating the incremental indexed rotational movement of the cap member 104 with respect to the rotary head member 96. It will be understood that by manually griping the serrations 122, the operator is able to effect incremental indexed rotational movement of the cap member 104 with respect to the rotary head member 96 through an angle of approximately 36° , as shown in FIG. 5. Stops 123 on hub portion 104 are engaged by the ends of indexing portions 118 to accomplish the angular limitation.

Figure 3:
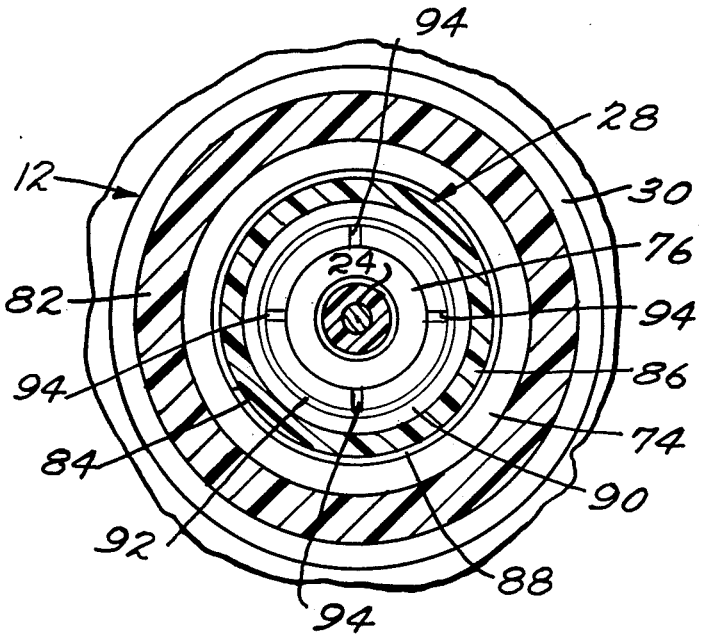
FIG. 3 is an enlarged fragmentary sectional view taken along the line 3—3 of FIG. 2.

As best shown in FIGS. 2 and 3, the cap member 104 includes a depending annular skirt portion 124. The lower periphery of the skirt 124 is formed with a plurality of sets of stream engaging depending integral elements 126, 128, 130 and 132. The number of sets of depending elements provided is equal in number to the number of outlets 102 formed in the rotary head member 96 and their annular spacing is generally equal to the annular spacing of the outlets 102. As is clearly shown in FIG. 6, the vertical extent of the depending elements in each set is progressively greater and the operative angular extent of each element of each set is equal to the angular spacing of the serrations 116 and 120 or one incremental indexed movement. It will be noted that elements 126, 128 and 130 are integral and present a continuous sloping stream interrupting surface. It will be understood that the continuous sloping surface could be a continuous stepped surface or separate diverging surfaces of different vertical extent as in U.S. Pat. No. 4,353,506. As shown, each element 132 is of sufficient vertical extent to cover the outlet when aligned therewith as shown in FIG. 6. Moreover, the inwardly facing surface of each element is dished out or formed with a greater concavity so as to insure that the water deflected thereby is maintained within a minimum circular pattern (e.g. four feet). Associated with all but one set of depending elements is a notch 134 which is positioned when aligned with an associated outlet 102 so as to be out of the path of movement of a stream issuing upwardly and outwardly of the outlet. It will also be noted that when the notch 134 of one set is angularly aligned with its associated outlet 102, the notches 134 of the other sets of stream modifying elements are angularly aligned with the other outlets 102. As best shown in FIG. 6, in lieu of the notch 134, the twelfth set is provided with a diverging surface element 136. Element 136 insures that the central portion of the circular pattern receives water when notches 134 are aligned with their respective outlets to achieve a maximum circular pattern (e.g. forty feet). By manually moving the cap member 104 one incremental indexed movement, the shortest depending element 126 of each set is brought into angular alignment with an associated outlet. The shortest element 126 thus engages or penetrates into the stream issuing from the aligned outlet 102 from above only a short distance so as to provide a minimum amount of stream deflection. By moving the cap member 104 another incremental indexed movement, the next stream modifying element 128 of each set is brought into angular alignment with an associated outlet 102 so as to provide a greater amount of stream deflection. Similarly, when the cap member 104 is moved another incremental indexed movement, the next stream modifying element 130 of each set is brought into angular alignment with an associated opening so as to provide maximum stream deflection except for separate element 136. In this way with the construction illustrated there are four progressively greater stream deflections which can be obtained by four incremental indexed movements of the cap member 104 with a fifth incremental indexed movement providing for stream integrity without deflection except for element 136. The arrangement is such as to achieve stream modification simultaneously with all twelve streams associated with all twelve outlets 102. Once the adjustment is made the stream modification occurs during all rotational positions of the rotary sprinkler distributor 28. It thus will be seen that the objects of this invention have been fully and effectively accomplished.

It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

I claim:

1. In a sprinkler including an annular head member having at least four water flow passages extending therethrough so that the outlet ends thereof extend in an upward and outward direction to the periphery of said head member in equal annularly spaced relation, a stream modifying cap member mounted on said head member for incremental indexed rotational movements about an upright axis of rotation, said cap member having formed on the periphery thereof sets of stream engaging depending elements of different vertical extent spaced apart a distance equal to the aforesaid incremental indexed movement of said cap member, said sets being equal in number and spacing to the number and spacing of said passage outlet ends and being arranged so that at each incremental position of indexed movement of said cap member the depending elements aligned with each passage outlet end is of the same vertical extent whereby the stream issuing from each passage outlet end at any indexed position is the same and each is changed in response to an indexed movement of said cap member, the improvement which comprises one of said depending elements of each set having an area sufficient to be engaged by the entire stream issuing from the outlet ends of said passages when said elements are aligned therewith, the stream engaging surfaces of said one elements being dished out so as to retain and deflect the streams so that they fall upon the pattern area with a minimum outward extent.

2. The improvement as defined in claim 1 wherein each of said sets includes four stream engaging depending elements.

3. The improvement as defined in claim 2 wherein means is provided for limiting the incremental indexed rotational movements to five such movements, four of which correspond with the positions of passage alignment of said four stream engaging depending elements.

4. The improvement as defined in claim 3 wherein at the fifth position of incremental indexed movement there is a space provided in association with all of said sets but one where a spreader stream engaging element is provided, the spaces enabling the streams to issue therefrom unobstructed to reach a maximum outward extent while the spreader element insures close in coverage as well.

5. The improvement as defined in claim 4 wherein the number of sets is twelve.

* * * * *